US009216343B2

(12) United States Patent
Kessler

(10) Patent No.: US 9,216,343 B2
(45) Date of Patent: Dec. 22, 2015

(54) SNOWBOARD

(76) Inventor: Hansjürg Kessler, Braunwald (CH)

( * ) Notice: Subject to any disclaimer, the term of this patent is extended or adjusted under 35 U.S.C. 154(b) by 1107 days.

(21) Appl. No.: 12/086,277

(22) PCT Filed: Nov. 28, 2006

(86) PCT No.: PCT/CH2006/000666

§ 371 (c)(1),
(2), (4) Date: Nov. 3, 2008

(87) PCT Pub. No.: WO2007/065280

PCT Pub. Date: Jun. 14, 2007

(65) Prior Publication Data

US 2009/0273161 A1 Nov. 5, 2009

(30) Foreign Application Priority Data

Dec. 9, 2005 (CH) ..... 1962/05

(51) Int. Cl.
*A63C 5/04* (2006.01)
*A63C 5/12* (2006.01)

(52) U.S. Cl.
CPC ..... *A63C 5/12* (2013.01); *A63C 5/0405* (2013.01)

(58) Field of Classification Search
USPC ..... 280/609
See application file for complete search history.

(56) References Cited

U.S. PATENT DOCUMENTS

| | | | | |
|---|---|---|---|---|
| 2,510,794 | A | 6/1950 | Beerli | |
| 5,244,227 | A | 9/1993 | Lacroix | |
| 5,405,161 | A | 4/1995 | Petkov | |
| 5,823,562 | A * | 10/1998 | Stubblefield | 280/609 |
| 5,954,356 | A | 9/1999 | Busby, Jr. et al. | |
| 6,352,268 | B1 * | 3/2002 | Peart | 280/14.21 |
| 6,481,741 | B1 * | 11/2002 | Porte | 280/609 |
| 6,986,525 | B2 | 1/2006 | Liard | |
| 2004/0084878 | A1 * | 5/2004 | Adamczewski | 280/602 |

FOREIGN PATENT DOCUMENTS

| | | |
|---|---|---|
| AT | 003 902 U1 | 11/1999 |
| CH | 1962/05 | 12/2003 |
| DE | 41 12 950 A1 | 11/1991 |
| DE | 299 20 650 U1 | 2/2000 |
| EP | 0 470 347 B1 | 9/1994 |
| EP | 0 928 622 A2 | 7/1999 |

(Continued)

OTHER PUBLICATIONS

European Patent Office, German excerpt from the European Register for EP 1960064 A0, Kessler, Hansjürg, (3 pages), cited in current opposition to EP 1960064, filed Jan. 28, 2011.

(Continued)

*Primary Examiner* — Jeffrey J Restifo
*Assistant Examiner* — Erez Gurari
(74) *Attorney, Agent, or Firm* — Pauley Erickson & Kottis

(57) ABSTRACT

A snow sliding board (1) includes a tip (8), a center area (13) and a tail (9) and with a sliding surface (10) with a concave tip uptilt (21), a convex center area (22) and a concave end uptilt (23), wherein the concave tip uptilt (21) in an area of a front saddle point (6) terminates in the convex center area (22) in the area of the front saddle point (6), wherein the sliding surface (10) has a concave roll-up surface (17) in an area of the tip uptilt (21), which makes possible a load-dependent shifting of the edge pressure.

24 Claims, 15 Drawing Sheets

(56) References Cited

FOREIGN PATENT DOCUMENTS

| | | |
|---|---|---|
| EP | 1 410 826 A | 4/2004 |
| FR | 2 786 108 A1 | 5/2000 |

OTHER PUBLICATIONS

German language Decision for German Utility 21 2006 000 050, Kessler, Hansjürg, (6 pages), cited in current opposition to EP 1960064, filed Jan. 28, 2011.
German language Decision cover sheet for German Utility 21 2006 000 050, Kessler, Hansjürg, (1 page), cited in current opposition to EP 1960064, filed Jan. 28, 2011.
German language extract and status dated for Swiss Design No. 132438, filed Nov. 29, 2005, Kessler, Hansjürg, (5 pages), cited in current opposition to EP 1960064, filed Jan. 28, 2011.
Photograph of Simon Schoch, Snowboarder, 2006 Winter Olympic Games, Turin, Italy, (1 page), cited in current opposition to EP 1960064, filed Jan. 28, 2011.
Elan Snowboards, "SG02 Speed 185," snowboard schematic drawing, No. SG02-01-2005, (1 page), cited in current opposition to EP 1960064, filed Jan. 28, 2011.
Grabner, Sigi, "Snowboards by Sigi Grabner," product brochure pages, (13 pages), cited in current opposition to EP 1960064, filed Jan. 28, 2011.
http://www.kessler-swiss.com/de-CH/technology/hansjuergKessler, "Technology—Hansjürg Kessler Interview," (2 pages), cited in current opposition to EP 1960064, filed Jan. 28, 2011.
http://www.kessler-swiss.com/de-CH/technology/kesslerShapTechnology/kst Revolution KST, "Die Revolution KST, Kessler Shap Technology and Klothoid Shape," (3 pages), cited in opposition filed Jan. 28, 2011.
Photographs of Swiss Snowboarding Team, 2006, Winter Olympic Games, Turin, Italy, (2 pages), cited in current opposition to EP 1960064, filed Jan. 28, 2011.
Grabner, Sigi, "Declaration/Oath of Sigi Grabner," in the German language, Jan. 10, 2014, (2 pages), cited in the current opposition to EP 1960064, filed Jan. 28, 2011.
Schoch, Simon, "Declaration/Oath of Simon Schoch," in the German language, Feb. 9, 2015, (3 pages), cited in the current opposition to EP 1960064, filed Jan. 28, 2011.
Elan Snowboards, "SG01 Speed 162, SG02 Speed 185, SB03 Speed 178, SG04 Speed 173, SG05 Speed 158 and SG06 Speed 154," snowboard schematic drawings, Nos. SG01-01-2005, (6 pages), cited in the current opposition to EP 1960064, filed Jan. 28, 2011.
Elan Sportingoods, Invoice No. KE 24000462, dated May 4, 2005 to All Mountain Sports Vertriebs, Lienz, Austria, (18 pages), cited in the current opposition to EP 1960064, filed Jan. 28, 2011.
Elan Sportingoods. Invoice No. KE 24001667, dated Dec. 14, 2005 to All Mountain Sports Vertriebs GmbH, Lienz, Austria, (10pp), cited in the current opposition to EP1960064, filed Jan. 28, 2011.
Kollmann, Michael, "Declaration/Oath of Michael Kollmann," in the German language, Jan. 10, 2014, (4 pages), cited in the current opposition to EP 1960064, filed Jan. 28, 2011.
Rakotoniaina-Waldner, Elisabeth, "Declaration/Oath of Elisabeth Rakotoniaina-Waldner," in the German language, Jan. 9, 2014, (3 pages), cited in the current opposition to EP 1960064, filed Jan. 28, 2011.
Elan Sportingoods, Invoice No. KE 24001364, dated Nov. 15, 2005 and Invoice No. KE 24000411, dated Dec. 7, 2005, to All Mountain Sports Vertriebs, Lienz, Austria, (4 pages), cited in the current opposition to EP 1960064, filed Jan. 28, 2011.
Grabner, Sigi, "Snowboards by Sigi Grabner," product brochure pages, (1 page), cited in the current opposition to EP 1960064, filed Jan. 28, 2011.
All Mountain Sprots Vertriebs GmbH, "SG Speedline," Catalog page, (1 page), cited in the current opposition to EP 1960064, filed Jan. 28, 2011.
Zooom Productions GmbH, Invoice No. R2811050890 for SG-Snowboards—Druck, dated Nov. 15, 2005, (2 pages), cited in current opposition to EP 1960064, filed Jan. 28, 2011.
All Mountain Sports Vertriebs GmbH, Austrian Post Office Receipts, dated Nov. 2, 2005 and Dec. 20, 2005 (5 pages), cited in current opposition to EP 1960064, filed Jan. 28, 2011.
Zoom Productions Gmbh, Invoice No. 0023-0609 for Visitenkarte Michi Dabringer Snowboards, dated Sep. 28, 2006, (2 pages), cited in current opposition to EP 1960064, filed Jan. 28, 2011.

* cited by examiner

SNOWBOARD

BACKGROUND OF THE INVENTION

Field of the Invention

The invention relates to a snow sliding board in accordance with the preamble of the independent claim.

SUMMARY OF THE INVENTION

Since the beginning of the alpine ski sport in the beginning of the twentieth century, the originally used simple wooden slats were continuously further developed, improved and perfected. In contrast to earlier times, skis and snowboards (snow sliding boards hereinafter) are often placed on edge when making turns, and in the ideal case the turn is performed entirely on the edge. It is possible by means of this to reduce drifting transversely in respect to the running direction and therefore to travel faster through the turn. The term "carving" is derived from "whittling" of these tracks.

Besides the parameters for the material and the progression of the thickness, the design of the running surface in a view from above (horizontal projection, outline) and in a lateral view (lateral projection) have decisive relevance in connection with the behavior of a snow sliding board. For carving to become possible, snow sliding boards have a restriction in their waist area in the horizontal projection which, in combination with the occurring bending, results in the effectively traveled radius. A problem in connection with current snow sliding boards lies in that, although their waist restriction in the horizontal projection is provided for carving, the side elevation was never matched to the new conditions.

The vertical curvature in the lateral projection and the lateral waist restriction in the horizontal projection of the snow sliding boards on the market are based on empirical knowledge of the manufacturers. Also, the ends, in particular the shovel (front end) of present-day snow sliding boards are produced in accordance with old, never changed patterns. The present-day shapes of the snow sliding boards are not optimally designed for carving, so that an increased resistance is created when running, which results in an unnecessary reduction in speed.

The ski industry has tried for years to optimize the equipment, but without any break-through in success, because the mechanics are being considered in a much too two-dimensional way. The ski manufacturer needs the lateral shape (outline) in the plan view for making a curvature. He needs the tip (shovel) so that the device does not get stuck. Seen in a lateral view, the shovel of a conventional snow sliding board typically extends vertically above the center area. Because of its strong curvature, the shovel provides considerable resistance, in particular when turning, and causes undesired braking.

According to its title, U.S. Pat. No. 6,986,525 (Rossignol S A) relates to a snow sliding board with an adapted curvature of the shovel and tail. One goal consists in showing a ski with a short waist restriction, whose supporting surface is intended to be increased in comparison with the prior art and which shows a positive behavior when entering turns. An ISO Standard 6289 is employed for defining the geometry, in which the snow sliding board, which otherwise is curved because of the bias, is pressed onto a level surface, so that it rests flat on it in its center area. The contact area being created by this is delimited by a front and a rear contact line (definition in accordance with the ISO Standard 6289). In the deformed state, i.e. when pressed onto the level surface, the widest area of the shovel lies on the front contact line and is between 5 mm and 15 mm distanced from the flat surface. However, this construction is already known from the prior art. In this prior art there is no connection provided between the design of the sliding surface in the horizontal projection and the lateral projection. This is also a two-dimensional way of looking at it.

The object of the invention consists in providing an improved snow sliding board, which has less resistance and improved traction, in particular when turning.

The object is attained by means of the invention defined in the independent claim.

In a lateral projection, a sliding surface of a snow sliding board has the following areas, viewed from the front to the rear: a concavely upturned tip, which constitutes the shovel in the front area, convex bias (center area), concave upturn of the end, which in the rear area terminates in the tail. The center area has a positive, upward-pointing convex curvature, which changes over into concave negative curvatures in the area of the ends. The areas in which the sign of the curvature changes are called saddle points. The curvatures have been selected such that a snow sliding board, placed on a level, rests on it only in the area of its concave end curvatures, the contact areas of the sliding surface, and is slightly lifted off it (bias) in the center area. The function of the invention is not negatively affected in a defined area by the geometry deviation, provided the curvatures, their relationship to each other and the transition points (saddle points) are arranged in such a way that the kinematics ("rolling effect", see further down below) appear when moving. The direction of curvature of the bias between the peripheries (shovel and tail) are defined as a positive convex curvature, and the peripheral curvatures in the area of the shovel and the tail are defined as a negative concave curvature. Existing miscellaneous straight sections between the convex and concave sections act in a certain way as deformation limitations, in that a snow sliding board can only be bent through to such an extent that these (both in the obliquely set and the flat state) rest along the entire length of their edges. Straight areas act as deformation limitations in particular when the curvature of the opposite side changes, i.e. from concave to convex. In connection with the invention here described, such straight areas are understood to be positive, convex curvatures, which substantially act as such.

In horizontal projection, the following elements are differentiated in the description of the limitations of the sliding surface (view from front to rear): tip end, waist restriction, tail end. Simplified arcs of a circle or straight lines are used for describing the geometry of the sliding surface, both in the lateral and in the horizontal projection, because these have geometric points which are useful for the explanation. However, in place of arcs of a circle and straight lines it is also possible to use other elements, such as ellipses, clothoids, parabolas, etc., for defining the geometry. Points, which have the greatest, or respectively the shortest, right-angled distance to a longitudinal axis of the snow sliding board, are identified as quadrant points (extreme points). For example, the tip end and the tail end start at a front, or respectively a rear quadrant point, which constitute the transition to the waist restriction. A center quadrant point can be found in the narrowest area of the waist restriction. Areas, in which the sign of the curvature changes (positive, negative, convex, concave), are understood to be saddle points. In particular, these are of special relevance for the definition of the lateral projections of the sliding surface.

When carving, when the snow sliding board, set on its side, is guided through a turn, it is elastically deformed in the center area because of the occurring loads, so that the originally convex curvature temporarily becomes a concave curvature. Superimposed on the deformation state occurring because of the load, the lateral waist restriction and the angle of cant (angle between the sliding surface and the ground when the snow sliding board has been set on its side), the lateral edge resting on the ground describes a substantially circle-shaped path in the ideal case, which corresponds in the ideal case to the turn to be traveled.

With the snow sliding boards presently available on the market, the contact areas and the saddle points in the shovel and tail area lie very closely together, typically the distance between these two areas is only 2% to 4% of the total length of the snow sliding board. Also, often the saddle point cannot be determined at all in the sense here discussed, because the sliding surfaces have straight intermediate pieces between the concave and convex areas, which act as deformation limitation. The median radii of the end areas (shovel, tail) are approximately 500 mm, and the median radii of the bias approximately 13,000 to 14,000 mm. As a rule, the shovel area (tip to contact point in the unloaded state) extends over approximately 10% of the length of the snow sliding board, so that the saddle point lies at approximately 12% to 14% of the total length. The effective edge length is reduced because of the great length of the tip. In the tail area, the contact area is approximately 2% to 4%, and the saddle point approximately 4% to 5% distant from the end (100%). In the course of bending a conventional snow sliding board, the contact area is only slightly displaced, because the contact area in the unloaded state and the saddle point are located very closely together, or respectively straight sections between the curvature changes prevent the deformation. Because of this, the tip always maintains approximately the same direction in relation to the ground, or respectively, the direction of travel. A tip, which is greatly upwardly inclined and curved is required, so that no digging-in results. Since the contact point and the saddle point are located very closely to each other, a conventional snow sliding board is always pressed the strongest against the ground in approximately the same area, regardless of bending. In this case, areas with the strongest edge pressure are located comparatively close to the end areas. As has been shown, this fact has a negative effect on the riding comfort and controllability. As a result of the strong edge pressure in the inlet areas of the edges, interferences, for example in the form of unevenness of the track, have a considerable effect on easy running and true tracking.

A concept of the invention achieves optimal interplay between physics during sliding and the mechanics of the sliding devices. This goal is achieved by matching, in accordance with the invention, the lateral projection and the horizontal projection during running, a deformation-dependent change, or displacement, of the high pressure along the edge in the form of a controlled rolling effect. In the course of this, edge areas with strong edge pressure are temporarily displaced toward the center of the snow sliding board in a directed manner, and the influence of the edges in the critical end areas is purposely reduced by this. A further concept of the invention results in a load-dependent changed uptilting of the tip during setting on the edge of the sports device that can take on an important role for introducing, or controlling, swing. This is not taken into consideration in conventional constructions.

One embodiment of a snow sliding board in accordance with the invention has a curvature transition (saddle point) between a convex bias radius and concave peripheral uptilting which, in contrast to a conventional snow sliding board, is arranged further in the direction toward the center (50% of the length of the snow sliding board). This arrangement forms a roll-up surface between the contact point and the saddle point, which makes possible a variable distribution of the edge force, in particular when cornering in the tilted state. Together with the interaction with the lateral waist restriction (horizontal projection), or respectively the waist restriction radius, of the snow sliding board and the occurring deformation during carving, in contrast to the prior art, the edge area under a high load is temporarily displaced toward the center of the snow sliding board and the critical edge areas are relieved. Because of the forces acting closer to the center, it can occur, depending on the embodiment, that the front, actively running edge areas in the inlet area are lifted off the ground at times, because the tip is deformed in the direction of the turn to be traveled, which results in an advantageous anticipation and introduction of the swing. This effect is aided in certain embodiments if the radius of curvature of the roll-up surface becomes smaller in the direction toward the tip of the snow sliding board. In connection with a tilted snow sliding board, the roll-up effect is the result of the acting forces, in that the snow sliding board is deformed in such a way that a "lowest edge area", which provides the contact between the edge and the ground relevant to the direction of travel, is displaced along the edge as a result of the occurring deformation. For all practical purposes, no load is placed on that area of the snowboard which, viewed in the linear direction, is located ahead of the lowest edge area, and therefore substantially maintains its original shape. The invention has the advantage that, because of the roll effect, it is possible to design particularly the end areas of the snowboard substantially stiffer in comparison to the prior art, so that less fluttering and high-frequency interference, such as typically appears at high speeds, occurs.

The distance between the contact area and the saddle point, as well as the radii of the end areas, are selected in such a way that a roll-up depending on a load of at least one of the end areas is achieved. Roll-up is here understood to be a temporary lifting, depending on a load, because of a shift of the contact area toward the longitudinal center and, connected therewith, the roll-up of the concave sliding surfaces in the end areas. With a center load, a controlled relief and a certain directional change of the peripheral areas, in particular when cornering, is caused by means of this roll-up effect. In the unloaded state, the distance between the contact areas and the saddle points in the area of the shovel and the end is approximately 8% to 20% of the entire length of the snow sliding board. Furthermore, in comparison with conventional snow sliding boards, the means radii of curvature have been selected to be substantially greater. In a preferred embodiment they are approximately 3000 mm and therefore approximately four to six times larger than with a conventional snow sliding board. It is achieved by means of the design in accordance with the invention that, with a load up to the saddle point, the contact area is shifted in the direction toward the center of the snow sliding board and the tip, or respectively the tail, are lifted in a controlled manner under a load. This effect also occurs during cornering when the snow sliding board is placed on edge, so that the swing is introduced more gently because of the controlled lifting of the tip of the snow sliding board.

Advantages of a snow sliding board in accordance with the invention result, inter alia, when traversing the edges of mountains, where, if possible, no changes in direction should be made, when controlling the swing on the ski run, in deep snow, or when running through gates. Basically, the speed when sliding will be higher under all snow conditions and applications, since an optimal lateral line is created because of the deformation occurring under the load, which results in a reduced resistance and a reduced susceptibility to external interferences. Also, dangerous digging-in of the tips because of the advance of the tip when radically carving turns is clearly reduced. A further advantage consists in making handling easier because of favorable running properties as a result of the changed pressure distribution along the edges, in particular in the peripheral area.

In one embodiment, in comparison with the prior art the tip of the snow sliding board is designed to be blunt and has, viewed in horizontal projection, a center area which has a radius of approximately 250 mm or more. In the transition area toward the front quadrant points, the horizontal projection has a radius of approximately 100 mm or less. A preferred embodiment has a mean radius of approximately 300 mm to 350 mm and lateral transition radii of approximately 60 mm to 80 mm. The vertical rise of the tip is approximately 10 mm to 30 mm.

One embodiment of the invention relates to a snow sliding board having a tip, a center area and a tail, and having a sliding surface with a concavely uptilted tip, a convex center area and a concavely uptilted tail, wherein the concavely uptilted tip terminates in the concave center area of the sliding surface in the area of a front saddle point. In one embodiment, the rise in the area of the front saddle point is 2° to 5° in relation to the contact areas in the unloaded state. Depending on the embodiment, it can assume a different value. In a preferred embodiment the rise is approximately 3°. In the area of the uptilted tip, the sliding surface has a concave roll-up surface, which makes a shifting of the edge pressure as a function of the load possible. Depending on the embodiment, the concave roll-up surface has a constant radius of curvature, or one which decreases in the direction toward the front end of the snow sliding board. If required, the radius of curvature of the roll-up surface in the direction toward the front end of the snow sliding board is designed to decrease continuously or discontinuously, at least over some areas. In connection with a preferred embodiment, the radius of curvature of the roll-up surface lies, depending on the area of application, in the range between 1000 mm and 5000 mm, or between 2500 mm and 3500 mm. The radius can decrease toward the front end. In a preferred embodiment, the radius in the area of the front end lies between 200 mm and 400 mm. Depending on the area of use (for example cross-country, freestyle, racing), the front contact area is arranged, 5% to 30%, 8% to 20% or 9% to 14% in front of the front saddle point. In a preferred embodiment, the front contact area in the undeformed state is arranged in relation to the total length L of the snow sliding board and depending on the area of application between 8% and 15%, 10% and 13%, or respectively 3% to 10% in front of the front contact area. Additionally, the snow sliding board can have a roll-up surface in the area of the uptilted tail. The invention is suitable for use in connection with snow sliding boards in which a variable edge force distribution results in advantages in the flow during the level and tilted state when turning, in particular in connection with snowboards, skis and monoskis.

BRIEF DESCRIPTION OF THE DRAWINGS

In the following description of the drawing figures, identical elements are defined by identical reference numerals. Shown are in.

DETAILED DESCRIPTION OF THE INVENTION

Figure 1:
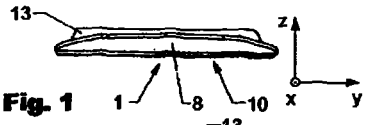
FIG. 1, a snow sliding board in accordance with the invention in a view from the front, FIG. 2, the snow sliding board in accordance with FIG. 1 in a view from the rear, FIG. 3, the snow sliding board in accordance with FIGS. 1 and 2 in a lateral view and a view from above.
Figure 2:
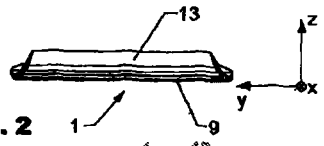
Figure 3:
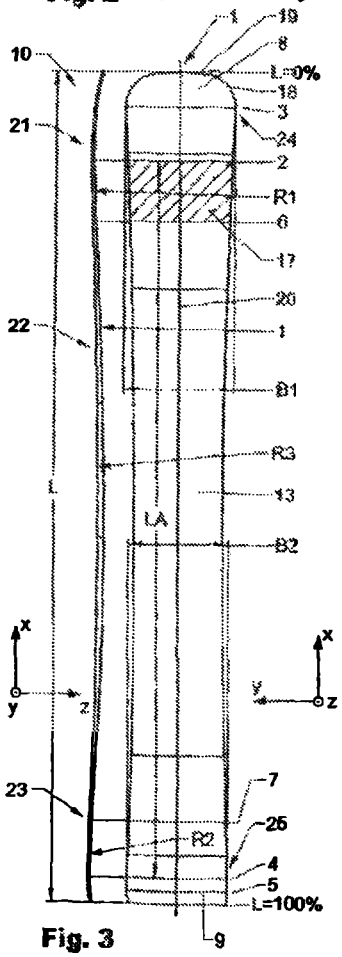

FIG. 1 shows a snow sliding board 1 in accordance with the invention in a view from the front, and FIG. 2 the same snow sliding board in a view from the rear. FIG. 3 shows the snow sliding board 1 in accordance with the invention and with FIGS. 1 and 2 in a lateral view (FIG. 3*a*) and in a view from above (FIG. 3*b*).

Figure 4:
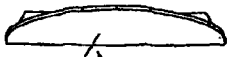
Fig. 4 PRIOR ART
FIG. 4, shows a conventional snow sliding board in accordance with the prior art in a front view.
Figure 5:
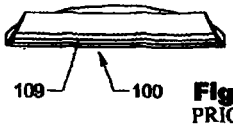
Fig. 5 PRIOR ART
FIG. 5, shows the snow sliding board in accordance with FIG. 4 in a view from the rear.
Figure 6:
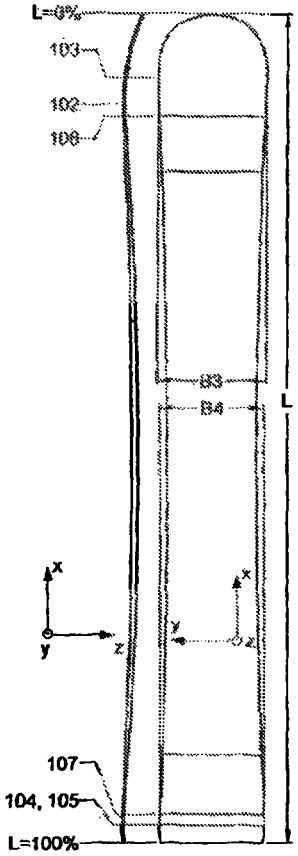
Fig. 6 PRIOR ART
FIG. 6, shows the snow sliding board in accordance with FIGS. 4 and 5 in a lateral view and in a view from above.

For comparison, FIG. 4 and FIG. 5 show a conventional snow sliding board 100 in a view from the front and a view from the rear. FIG. 6 shows the conventional snow sliding board 100 in accordance with FIGS. 4 and 5 in a view from the side (FIG. 6*a*) and in a view from above (FIG. 6*b*). For a better comparison, the scale of the conventional snow sliding board 100 corresponds to the length L of the snow sliding board 1 in accordance with the invention in FIGS. 1 to 3.

FIG. 1 shows the snow sliding board 1 with a tip 8, a center area 13 and a tail 9. The snow sliding board has a sliding surface 10 with a concave tip uptilt 21, a convex center area 22 and a concave tail uptilt 23, wherein, in the area of a front saddle point 6, the concave tip uptilt 21 terminates in the concave center area 22 of the sliding surface 10. In the area of the tip uptilt 21, the sliding surface 10 has a concave roll-up surface 17, which makes possible a shifting of the edge pressure as a function of the load. A device axis 20 (x-axis) has been schematically drawn in.

As can be seen from FIGS. 1 and 2, the invention here disclosed makes it possible to design the tip very flat, and therefore in a manner advantageous to flow, when required. It is obvious in the represented embodiment that in the front view in accordance with FIG. 1, in the undeformed state the silhouette of the tip 8 does not project above the convex center area 13. As can be seen in the view from above in FIG. 3, in the represented embodiment of the invention the front contact area 2 is located at approximately 11% of the total length L of the snow sliding board in the unloaded state, and the front quadrant point 3 of the front maximal width B1 is located at approximately 4.5% of the total length L. It can be seen from the lateral view in FIG. 3 that the rear contact area 4 is located at approximately 96% of the total length L, and the rear quadrant point 5 of the maximal rear width B2 is located at approximately 98% of the total length L. In the represented embodiment, the front saddle point 6 is located at approximately 18%, and the rear saddle point 7 at approximately 90% of the total length L. Thus, with reference to the total length L, the front saddle point 6 is distant by approximately 7% from the contact area 2, and the rear contact area 4 is approximately 6% distant from the rear saddle point 7. In the front saddle point, the rise amounts to approximately 3°, making reference to the contact points 2, 4. The area between the contact area 2 and the front saddle point 6 is used as the roll-up surface 17, along which the contact area is displaced under load in the direction toward the front saddle point 6. In the front, the areas 3, 5 of the maximum widths B1 and B2 are located approximately 13.5% away and in the rear approximately 8% away from the closest respective saddle point 6, 7.

As can be seen in the view from above in FIG. 6, in the no-load state the front contact area 102 is located at approximately 11% of the total length L of the snow sliding board, and the area 103 of the front maximal width B3 at approximately 7.6% of the total length L. It can be seen from the lateral view in FIG. 6, that the rear contact area 104 and the area 105 of the rear maximal width B4 are located at approximately 98% of the total length L. In the represented embodiment, the front saddle point 106 is located at approximately 12%, and the rear saddle point 107 at approximately 96% of the total length L. Accordingly, with reference to the total length L, the front saddle point 105 is approximately 1% distant from the contact area 107, and the rear contact area 104 is approximately 2% distant from the rear saddle point 7. The areas 103, 105 of maximal width B3 and B4 are distant in front by approximately 4.4% and in the rear by approximately 2% from the closest respective saddle point 106, 107.

In accordance with FIG. 3, the front contact area 2 of the tip 8 and at the front saddle point 6, the mean radius R1 of the snow sliding board in accordance with the invention is approximately 3000 mm and decreases to approximately 400 mm towards the front end. At the tail 9, the radius R2 in the rear contact area 5 is approximately 1200 mm. Viewed from the side (lateral projection), the sliding surface 10 has a mean radius R3 of approximately 15,000 mm in the convex bias area 11. As a result of the design in accordance with the invention, because of the comparatively large radii R1, or respectively R2, and of the curvature (spacing in the contact area 2, 5), which has been drawn far to the back, in the contact area 2, 5, the sliding surface 10 may serve as a virtual rolling surface, along which the contact area can be temporarily shifted as a function of the deformation state. Here, rear, or respectively, front limits are constituted by the saddle points 6, 7.

In the center area 13, the snow sliding board has a waist restriction radius of approximately 20,000 mm in the horizontal projection which, in the represented embodiment, decreases to 13,000 mm in the area of the maximum front width B1. The radius is approximately 15,000 mm in the area of the rear maximal width B2. In the horizontal projection, the comparatively bluntly embodied tip 8 has a radius of approximately 350 mm in the center, which decreases to approximately 80 mm in the end areas 11, 12. In this case the rear end of the represented embodiment of the snow sliding board 1 in accordance with the invention is designed to be substantially straight. Here, the radii in the area behind the rear maximal width B2 are approximately 100 mm. An advantage of the represented embodiment lies in that, in spite of the comparatively bluntly embodied tip 8, which furthermore here has only a rise of approximately 20 mm in the vertical direction, no digging-in occurs in the course of running because of the roll effect in accordance with the invention.

Figure 7:
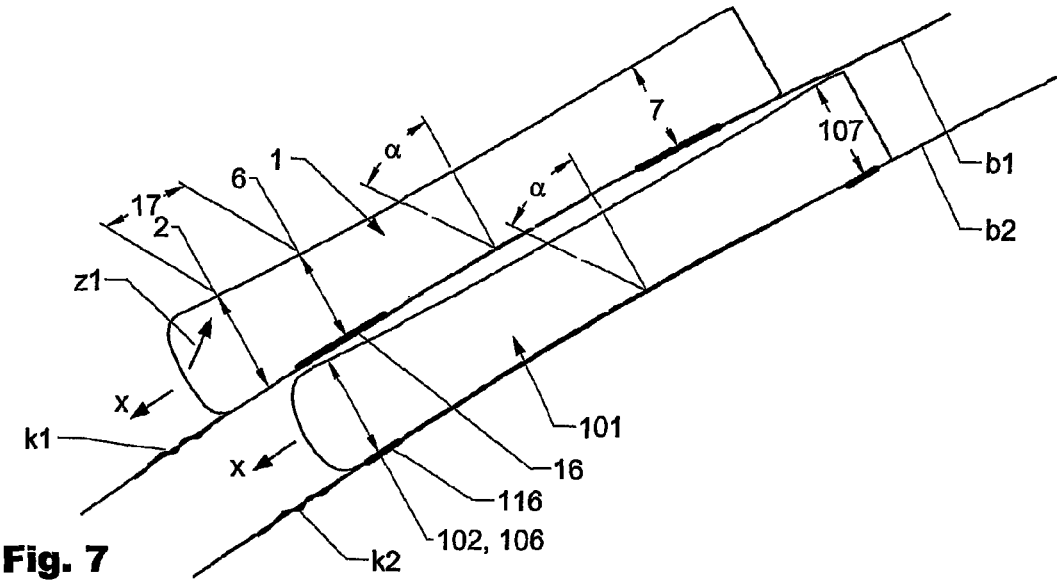
FIG. 7, shows in a perspective representation the snow sliding boards in accordance with FIGS. 1 to 3 and 4 to 6 in a turn.

FIG. 7 shows the two snow sliding boards 1, 101 in accordance with FIGS. 1 to 6 in a turn. Both snow sliding boards 1, 101 move through a curved turn b1, or respectively b2, of the same radius in the direction x. The snow sliding boards 1, 101 are represented in a bent state, such as would approximately occur in the course of a corresponding standing on edge in relation to the ground at a tilt angle α.

In contrast to a conventional snow sliding board 101 (foreground in the drawing), because of the design in accordance with the invention of the horizontal and lateral projections, the front area with a high edge pressure 16 (lowest edge areas) of a snow sliding board in accordance with the invention (background of the drawing) is displaced substantially farther toward the longitudinal center (L=50%) in the course of turning than with a conventionally equipped snow sliding board (see the snow sliding board 101, area 116). Based on the relatively large distance between the contact area 2 (see FIG. 3) and the saddle point 6 in the unloaded state, and the comparatively large concave radius R1 of curvature in the tip area, in case of a deformation as a function of the load, the tip 8 is lifted because of the roll-up effect (schematically represented by the arrow z1). That is, the tip 8 rotates around the contact area 16, which was shifted toward the rear which, on the one hand, results in a reduction of the edge pressure in this critical front area and, on the other hand, makes possible an "anticipation" as a function of the load of the tip in the direction of the curved turn b1 to be negotiated. In this case, the area between the contact area 2 and the front saddle point 6 is used as the roll-up surface 17. As a result of the reduced edge load in the run-in area of a snow sliding board 101 designed in accordance with the invention, interferences, for example uneven ground k1, k2 in the form of short waves, therefore will have a substantially lesser influence than with a conventionally designed snow sliding board 101.

Figure 8:
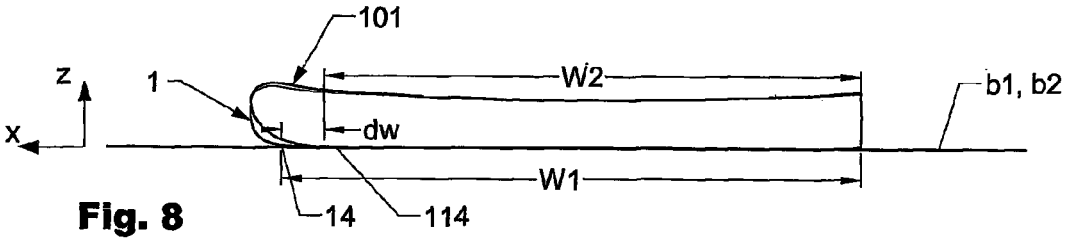
FIG. 8, shows the snow sliding boards in accordance with FIGS. 1 to 3 and 4 to 6 in a lateral view in a turn.

FIG. 8 shows the two snow sliding boards 1, 101 in accordance with FIG. 7 in a lateral view (y-direction) in the track area (represented in a simplified manner as x-y-plane). As can be seen, the invention makes it possible to design a snow sliding board 1 in such a way that, at an identical total length L (see FIG. 3, or respectively 6), the effective length W1 of the lateral edge 14 can be designed to be substantially longer. In the represented embodiment, the difference dw of the effective edge length W1 of the lateral edge 14 in comparison to the effective edge length W2 of the lateral edge 114 of the conventionally designed snow sliding board 101 is approximately 4% to 5% (in relation to the total length L of the snow sliding board).

Figure 9:
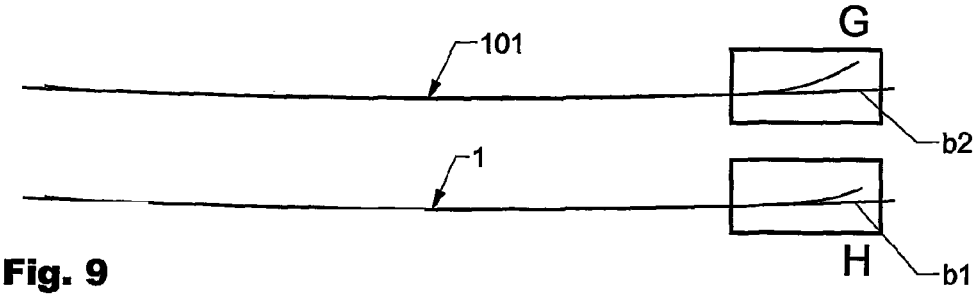
FIG. 9, shows the snow sliding boards in accordance with FIGS. 1 to 3 and 4 to 6 from the side in the direction of the sliding surfaces in a turn.
Figure 10:
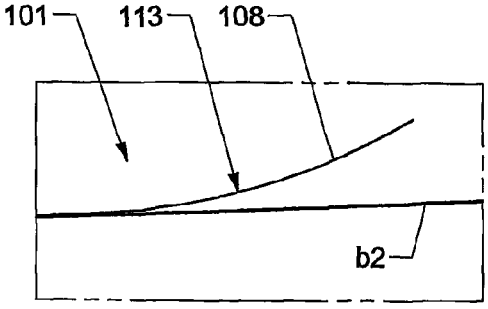
FIG. 10, shows a detail G from FIG. 9, FIG. 11, shows a detail H from FIG. 9, FIG. 12, a diagram of a first snow sliding board, FIG. 13, a diagram of a second snow sliding board, FIG. 14, a diagram of a third snow sliding board, FIG. 15, a diagram of a fourth snow sliding board, FIG. 16, a diagram of a fifth snow sliding board, FIG. 17, a diagram of a sixth snow sliding board, FIG. 18, a diagram of a seventh snow sliding board, FIG. 19, a diagram of an eighth snow sliding board, FIG. 20, a diagram of a ninth snow sliding board, FIG. 21, a diagram of a tenth snow sliding board, FIG. 22, a diagram of an eleventh snow sliding board, FIG. 23, a diagram with the radii of the front roll-up surfaces, FIG. 24, a diagram with the radii of the waist restriction in front of a front saddle point.
Figure 11:
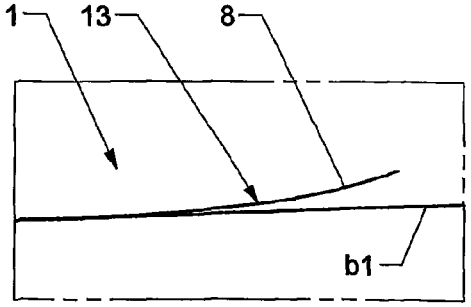
Figure 12:
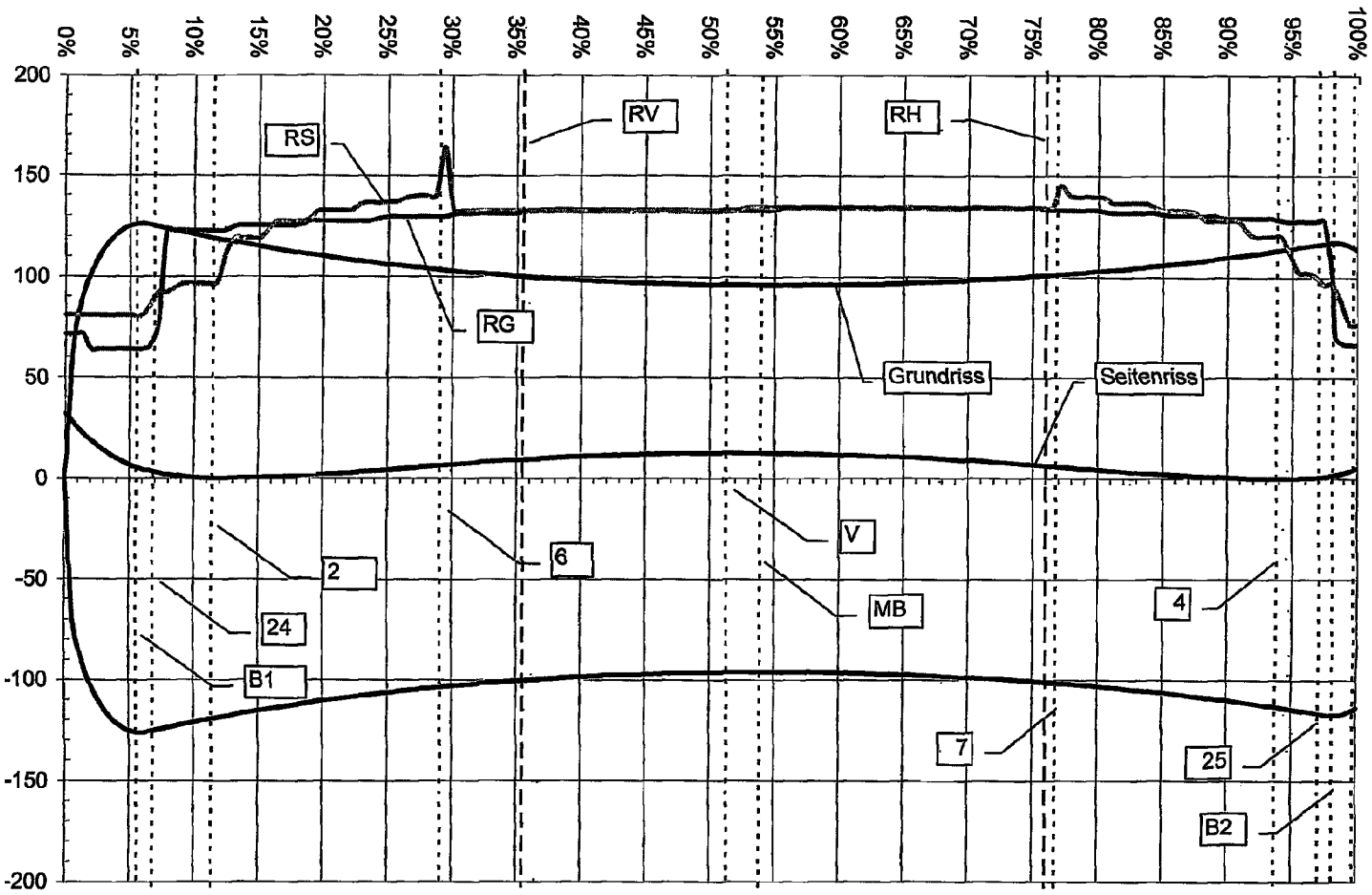
Figure 13:
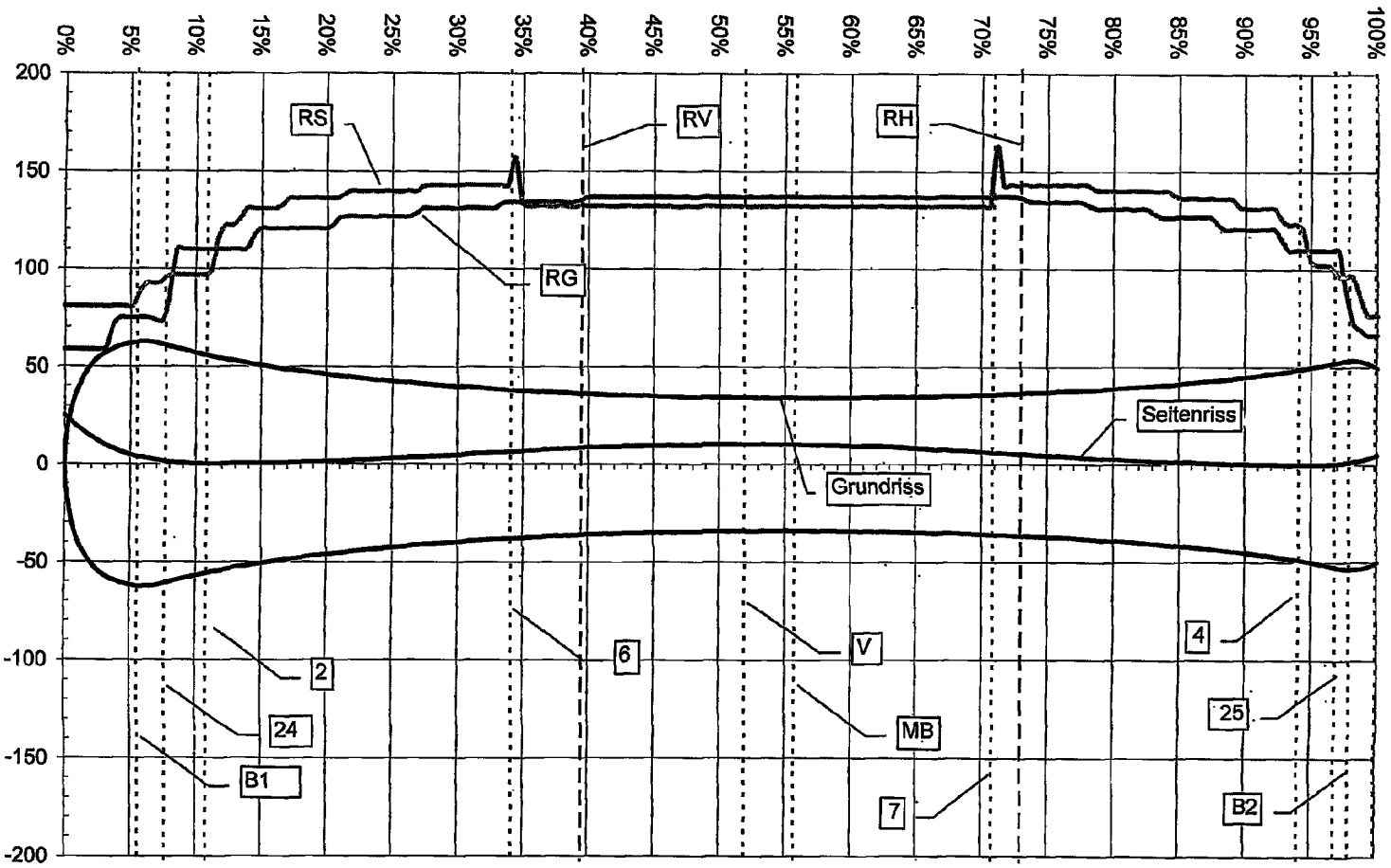
Figure 14:
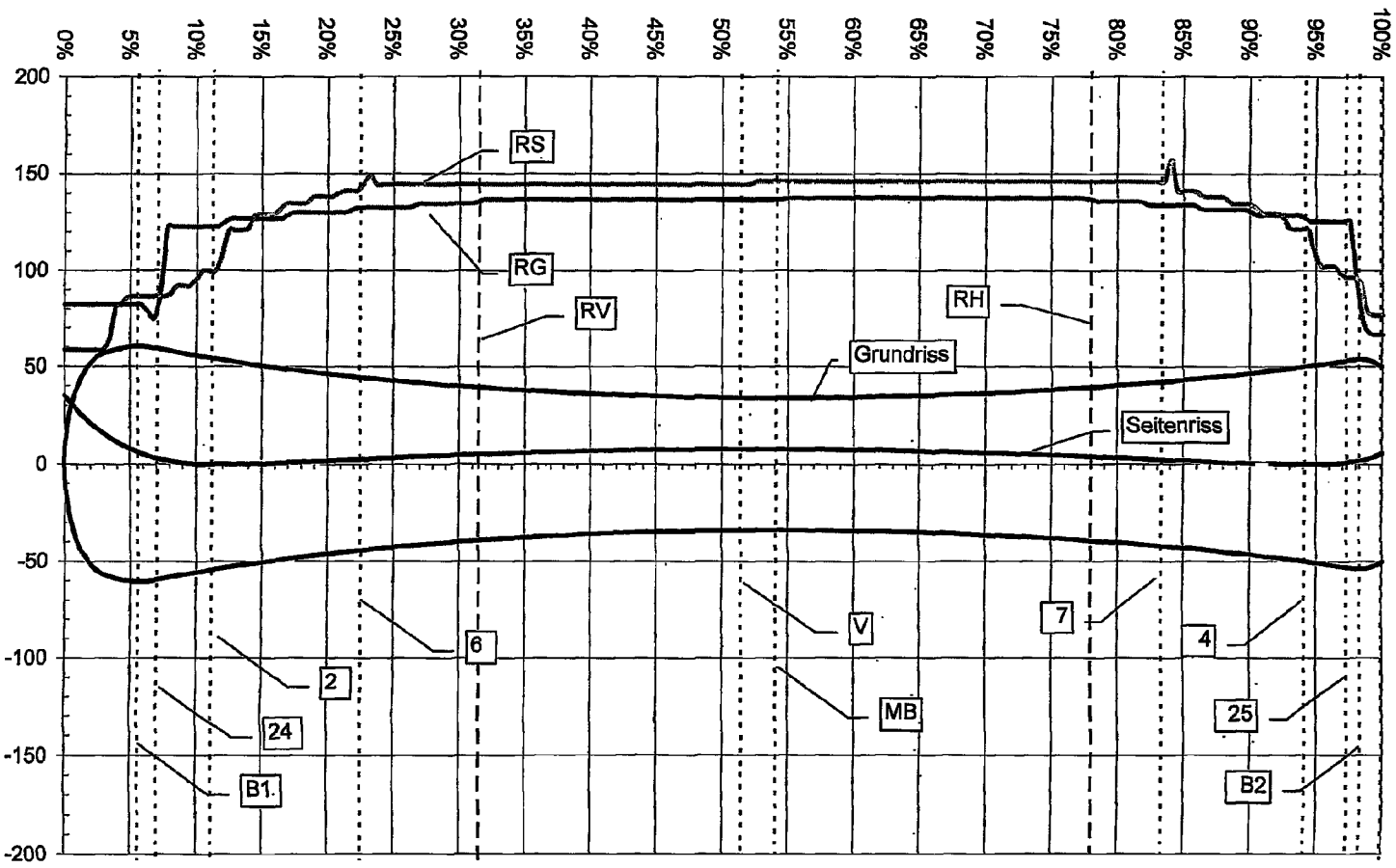
Figure 15:
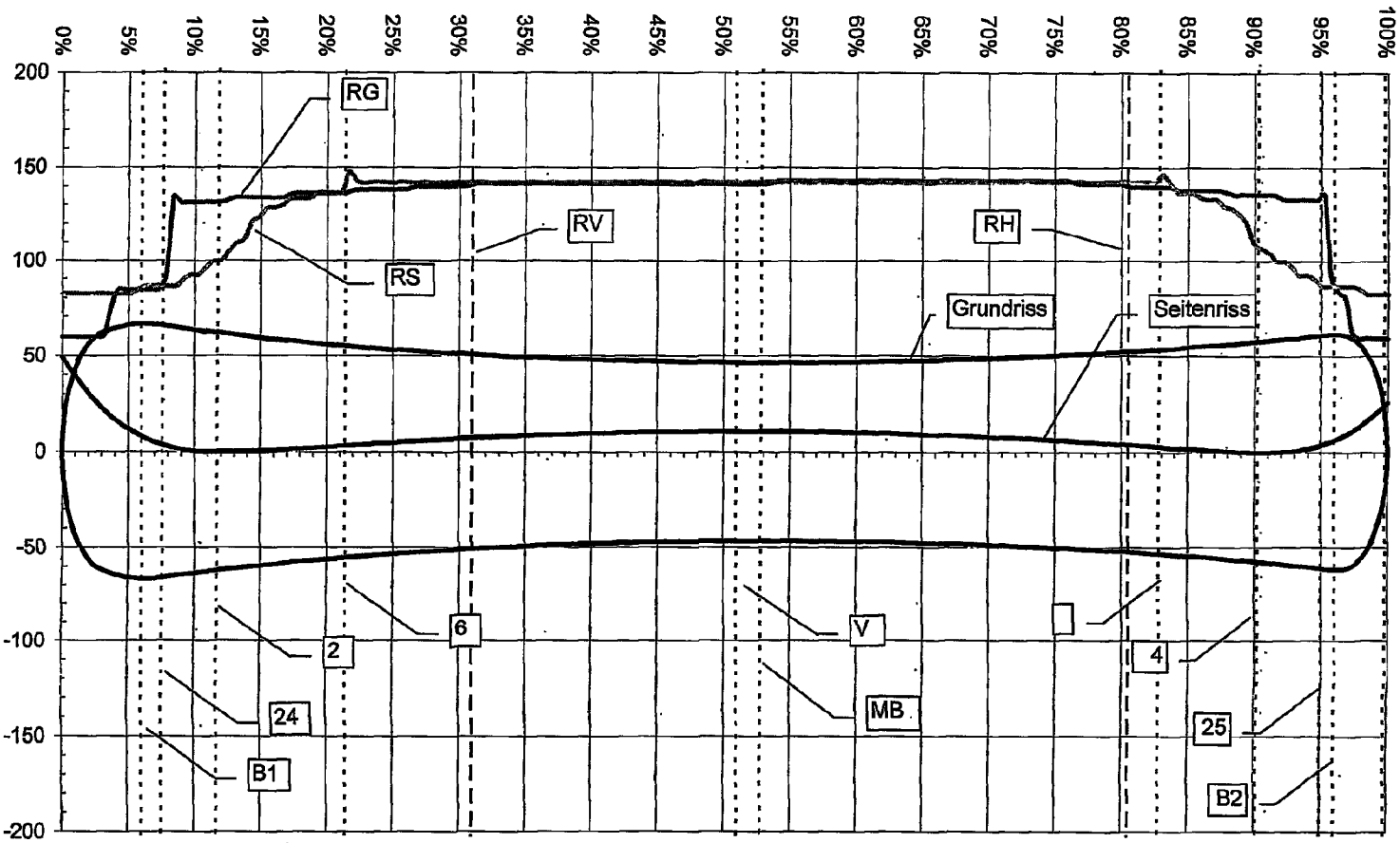
Figure 16:
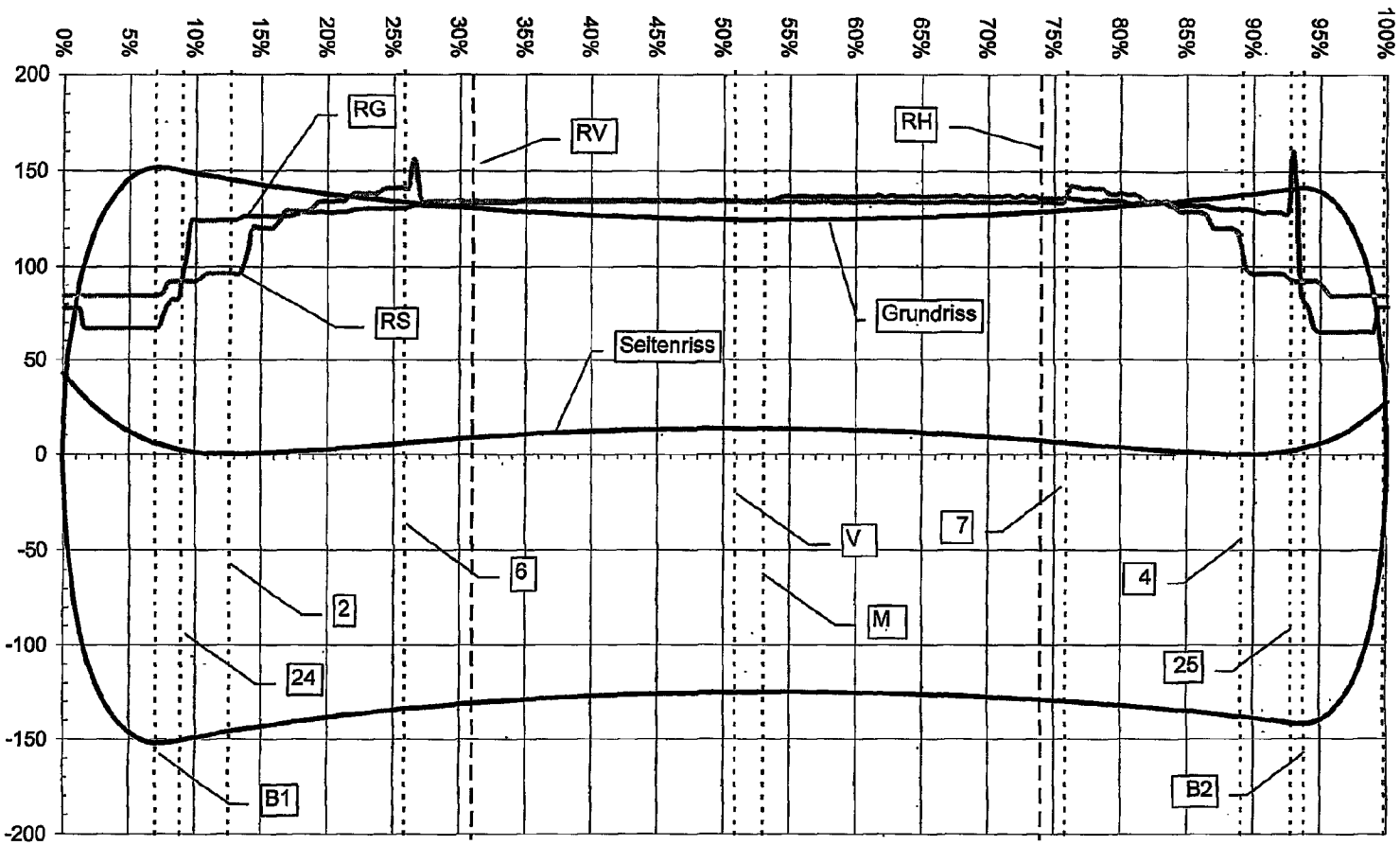
Figure 17:
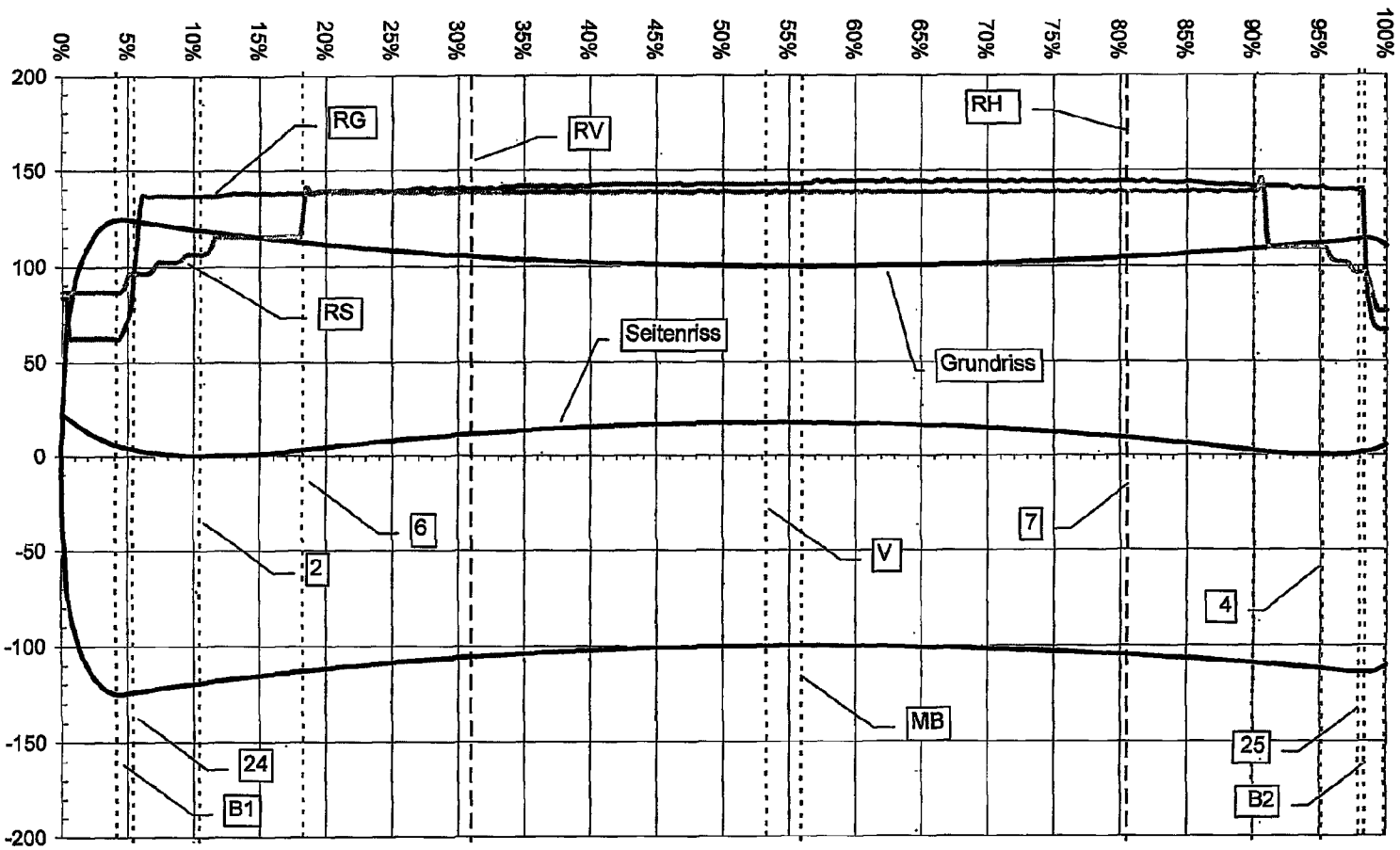
Figure 18:
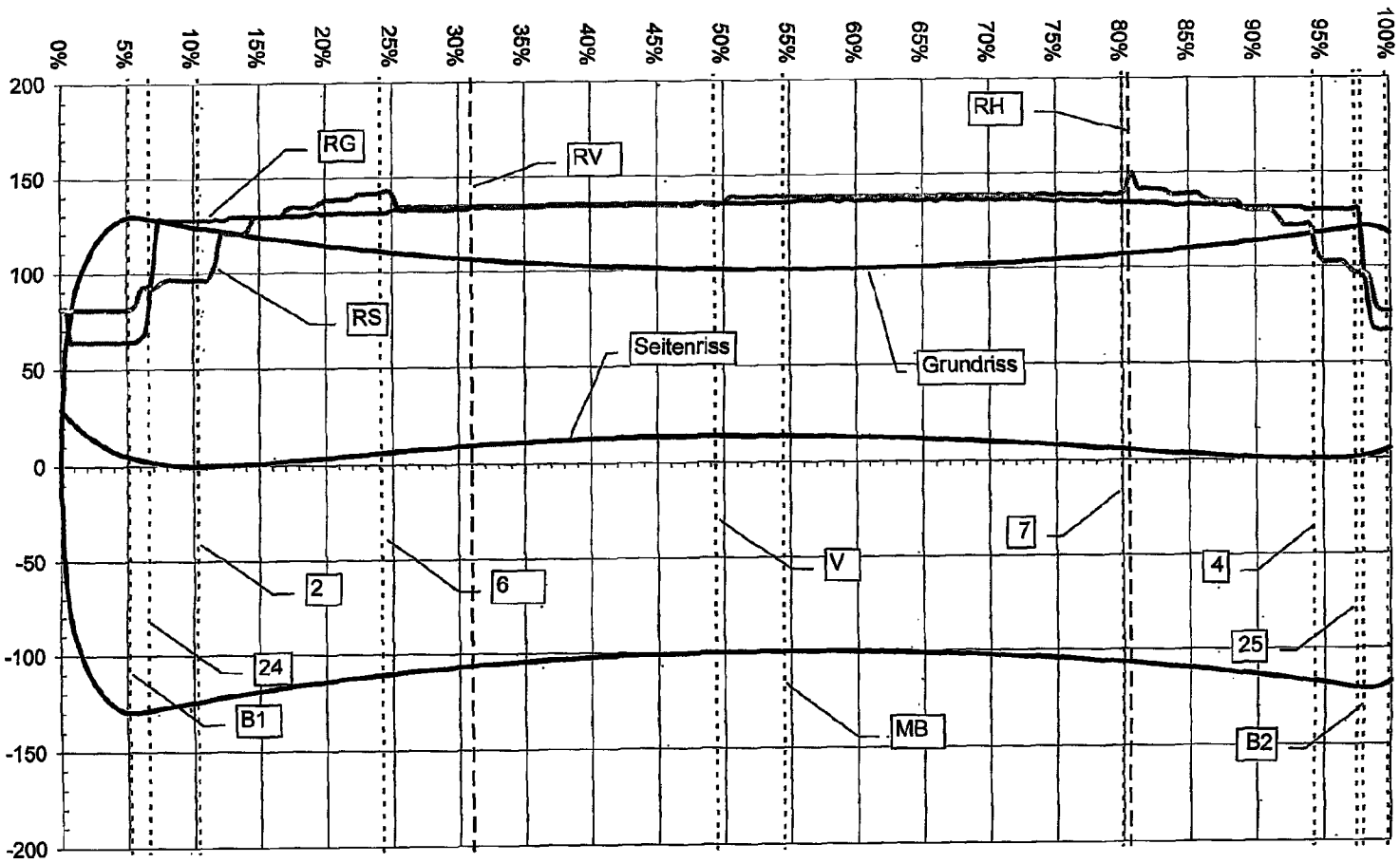
Figure 19:
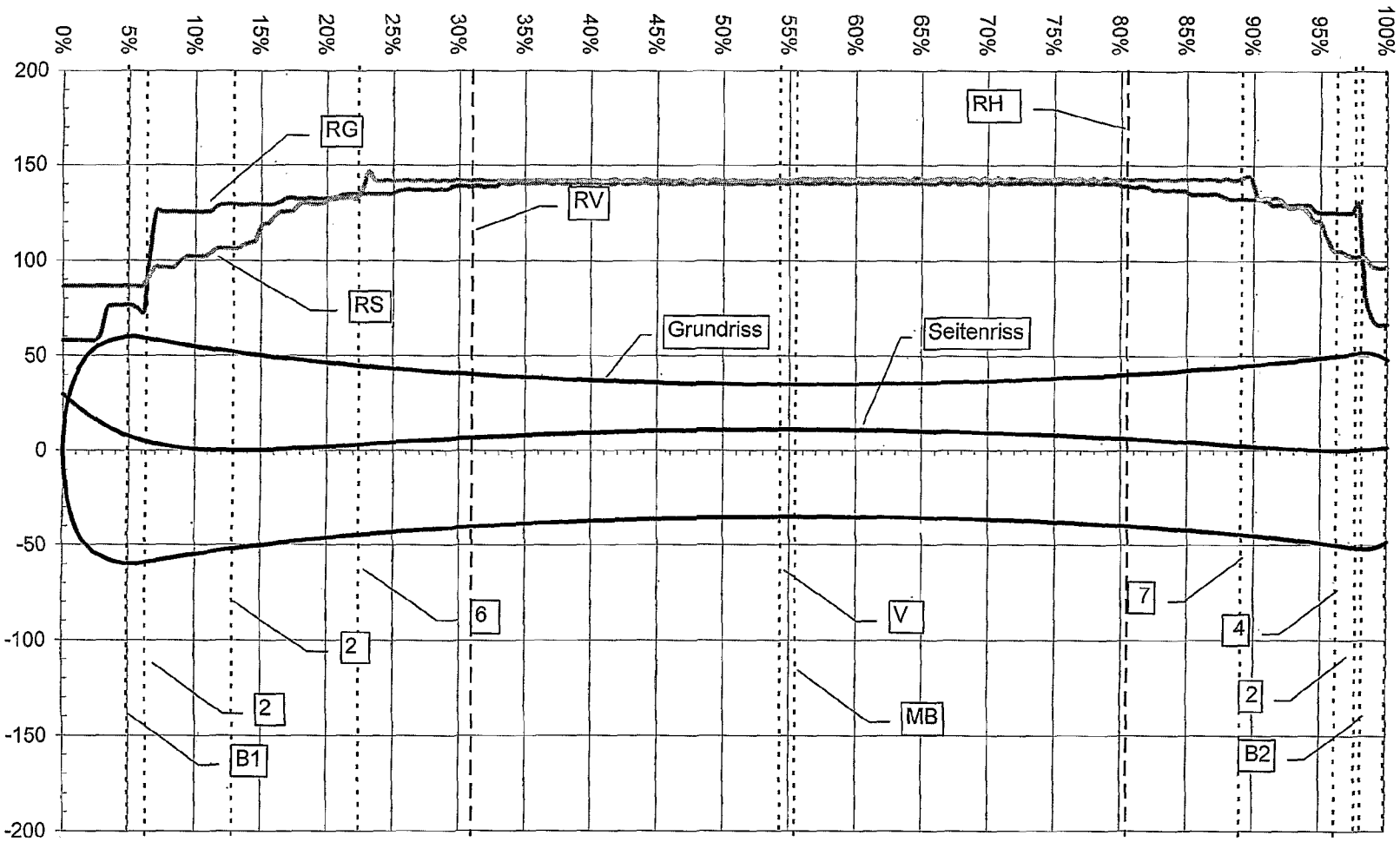
Figure 20:
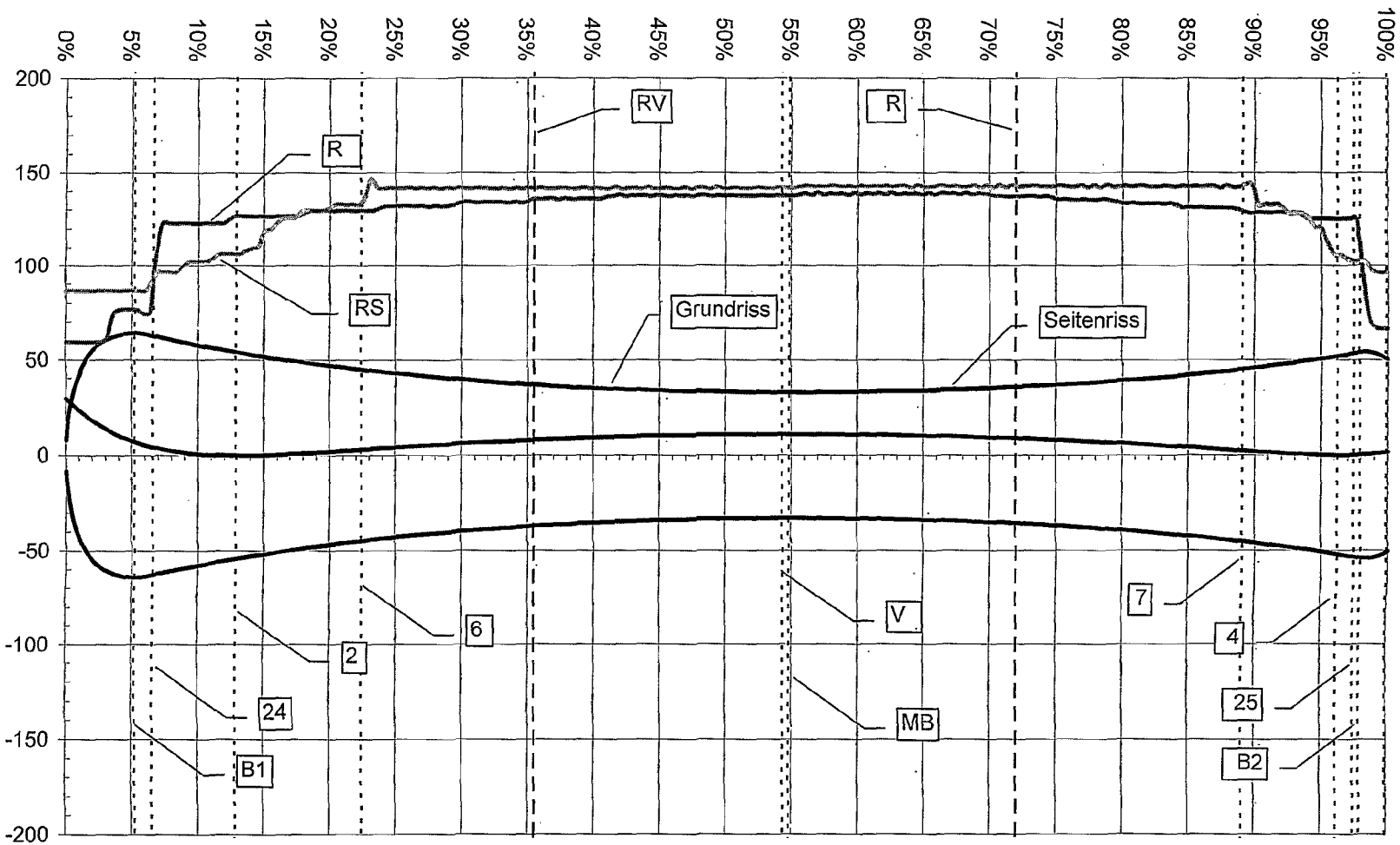
Figure 21:
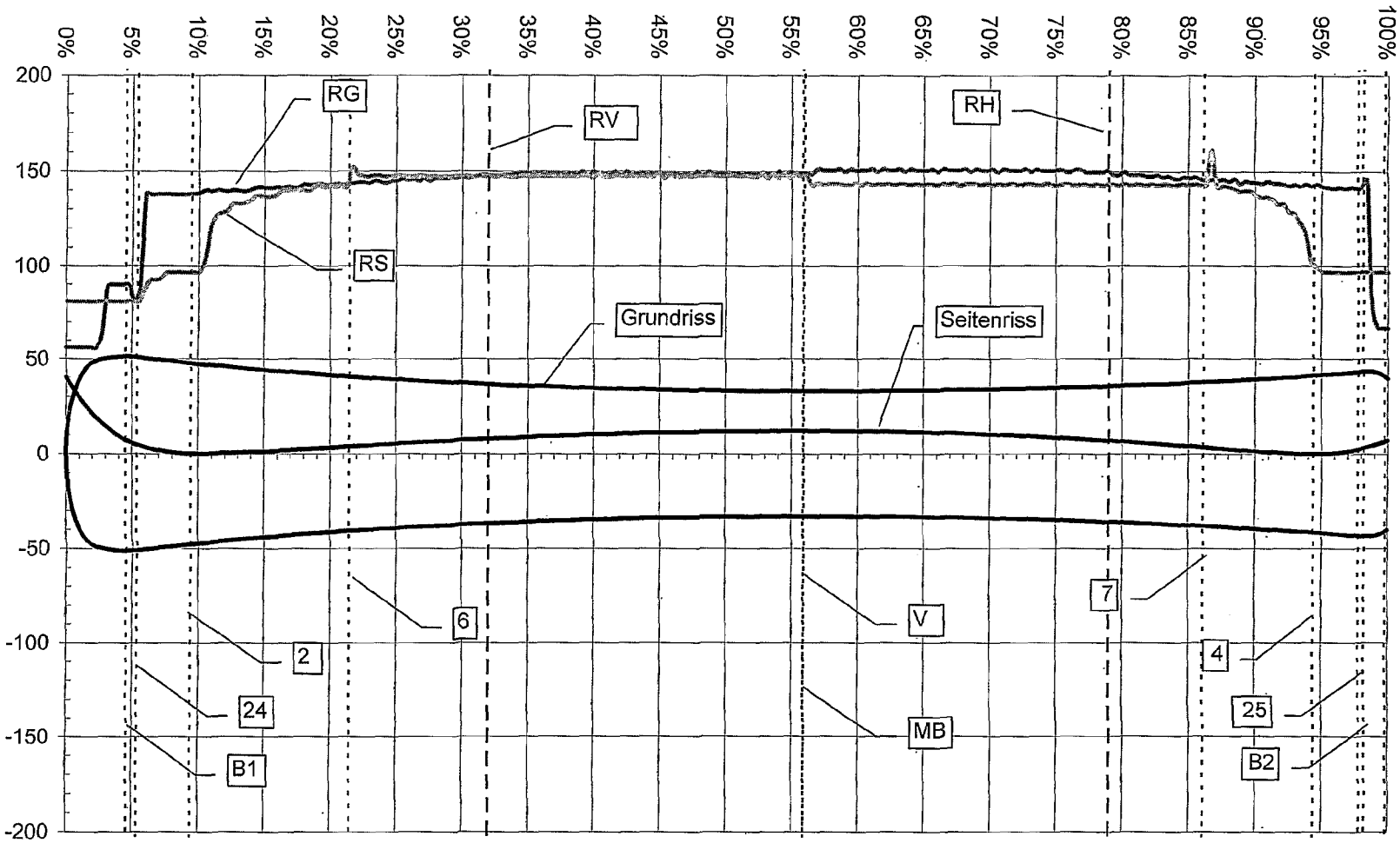
Figure 22:
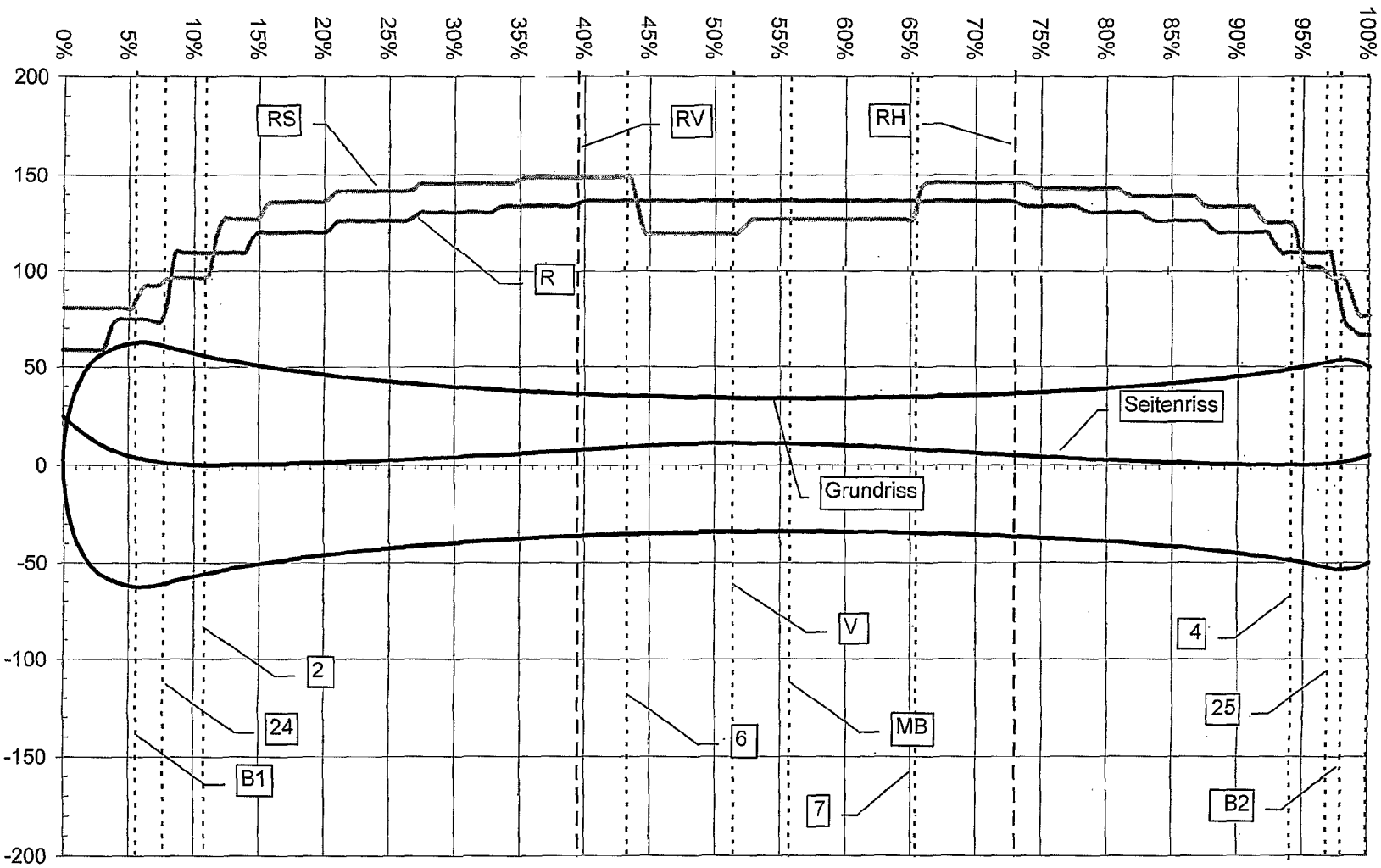

FIG. 9 shows the snow sliding board in accordance with the invention and the conventional one 1, 101 in a lateral view in the plane of the snow sliding boards. The curved turns b1, b2 to be negotiated are schematically represented and are located in the plane of the track. Because of the tilt angle α (see FIG. 7), only one projection of the curved turns b1, b2 can be seen. FIGS. 10 and 11 show an enlarged representation of the details G and H in FIG. 9.

In a view from the side, FIG. 10 schematically shows the course of the sliding surface 113 of a conventional snow sliding board 1 in a lateral view, and FIG. 11 the course of the sliding surface 13 of a snow sliding board in accordance with the invention. The sliding surfaces 13, 113 are schematically represented in the deformed state. Because of the tilted arrangement, the represented curved turns are to be understood as a projection of the actually traveled curved turns b1, b2. As can be noted, the tip 8 (see FIG. 11) of the snow sliding board 1 designed in accordance with the invention is embodied substantially more flat than the tip 108 of the conventional snow sliding board 101. A very gentle flow against the snow sliding board 1 in accordance with the invention occurs because of the very large negative curvatures at the peripheries. In contrast to the conventional snow sliding board 101, less resistance is created because of this. Because the contact pressure can build up over a longer distance at the front of the tip 8, the air is displaced less rapidly. Because of this, more air will get underneath the sliding surface 13, which in turn can have a positive effect on the speed.

FIGS. 12 to 22 show eleven embodiments of snow sliding boards—skis and snowboards—by means of diagrams. A horizontal projection (view from above in accordance with FIG. 3*b*) and a lateral projection of the sliding surface 22 (view from the side in accordance with FIG. 3*b*) can be seen in each drawing figure. These are real geometries of the snow sliding boards represented in the diagrams, and therefore exact data to this extent. The length (X-axis) is scaled to 100% in order to take different lengths into account, or respectively to be able to better compare different snow sliding boards with each other. The effective length is of subordinate importance for the contemplations here. Instead, the prevailing conditions are more important. In the case of the horizontal projection (actual y-direction), the y-axis of the diagram shows the width, and in the case of the lateral projection (actual x-axis) the height of the snow sliding board. Although the width and height (bias) can also vary, they are scaled in millimeters (mm) in the represented FIGS. 12 to 22. It is self-evident that, for describing the running properties, the conditions and relative values are also primarily important here, and the actual values are less important. Therefore the dimensions can vary from the represented values without the properties being negatively affected.

Moreover, two curves can be seen in each diagram in FIGS. 12 to 22, which represent the courses of the waist restriction radii (RG; radii of the lateral edges in horizontal projection) and of the sliding surfaces (RS; curvature of the sliding surface 12 in lateral projection). Since the radii of the curves are comparatively large and can be subject to strong fluctuations in spite of the steady geometric course, the radii are represented as logarithms of the base 2 with a scaling factor 10 in accordance with the following equation: $R=2^{(r/10)}$. R corresponds to the actual radius and r to the value represented in the diagrams (for example $1024=2^{(100/10)}$[mm]). As follows from the courses of the curves RG and RS, the horizontal and lateral projections (sliding surfaces) are composed of radii, in particular in the area of at least one saddle point. In the course of the sliding surface in particular, no straight partial elements exist in the saddle points (change in curvature), which have a negative effect on the running behavior in that they limit the deformation, for example. In connection with the sliding surface this has the result that the ends, tip and/or tail can roll-up as far as the saddle points.

As a rule, the lateral projections (sliding surface) in the diagrams in FIGS. 12 to 22 have the greatest average sliding surface radius RS in the convex center area between the saddle points (the position is indicated by the two vertically extending lines 6 and 7). In the direction toward the concave ends (tip/tail), the sliding surface radii decrease continuously as a rule. Larger transition radii can briefly occur in the transition areas. Short, straight sections, which have no effect on the function and in particular are not located in the area of a curvature change, are not considered here and are therefore also not represented.

As a rule, the sliding surface radii RS decrease comparatively more strongly than the waist restriction radii RG in the area between the saddle points 6, 7 of the sliding surface and the saddle points 24, 25 of the horizontal projection. This can be detected in that on the average the curve of the sliding surface radii RS tends to extend more steeply than the curve of the waist restriction radii RG. Also, in the direction toward the saddle points 24, 25, the sliding surface radii RS have a tendency to be smaller than the waist restriction radii.

In the convex center area between the saddle points 6, 7 of the sliding surface 10 (see FIG. 3), the waist restriction radii RG also have the largest average waist reduction radius. Depending on the field of application and the type of snow sliding board (ski, snowboard), the waist restriction radii are greater, equal to or smaller in the center area than the sliding surface radii.

It also follows from the diagrams in FIGS. 12 to 22 that, as a rule, the curve of the waist restriction radii RG, except for the extreme examples, is reduced sooner in the direction toward the ends (tip, tail) than the curve of the sliding surface radii RS which, as a rule, drops downward in the direction toward the x-axis at the saddle points 6, 7. The drop points of the waist restriction radii are schematically represented by the two vertical straight lines RV and RH. As a rule, the drop-off areas RV and RH are located within (between) the drop-off areas of the sliding surface radii RS. In relation to the total length L of the snow sliding board, the front drop-off area RV is located between −5% to 20% farther away from the tip (0%) than the front saddle point 6 of the sliding surface radii RS (negative values mean outside of the area between the saddle points 6, 7). In relation to the total length, the drop-off area RH toward the tail is also located between −5% to 20% distant from the rear saddle point 7.

The values of the snow sliding boards from FIGS. 12 to 22 are compiled in Table 1. While the absolute values relate to the total length L, the relative values are directed to the length $L_A$ between the contact areas 2, 4 in the undeformed state. The drop-off area of the waist restriction radii RG lies between the maximal values of 13% and 17% in relation to the absolute length L. The saddle points 6, 7 in the lateral projection indicate how far the snow sliding board can roll up.

| | Lateral Projection (sliding surface) | | | | | Horizontal Projection |
|---|---|---|---|---|---|---|
| Dimensions, % Tolerance range; | Contact point, front (APV, 2) | Saddle point, front (SPV, 6) | Bias (V) | Saddle point, rear (SPH, 7) | Contact point, rear (APH, 4) | Maximum width, front (b1) |
| KST 153 (FIG. 12) | 11.4 | 29 | 51.2 | 76.8 | 93.8 | 5.5 |
| Respectively in relation to | 0.0 | 21.4 | 48.3 | 79.4 | 100 | −7.2 |
| SPV-APV (absolute) | 17.6 | APH-SPH (absolute) | | | 17 | |
| Extreme carving 148 (FIG. 13) | 11 | 34 | 52 | 71 | 94 | 5.5 |

-continued

| | | | | | | |
|---|---|---|---|---|---|---|
| Respectively in relation to | 0.0 | 27.7 | 49.4 | 72.3 | 100 | −6.6 |
| SPV-APV (absolute) | 23 | APH-SPH (absolute) | | | 17 | |
| Free carving 163 (FIG. 14) | 11.2 | 22.4 | 51.3 | 78 | 94.1 | 5.7 |
| Respectively in relation to | 0.0 | 13.5 | 48.4 | 80.6 | 100 | −6.6 |
| SPV-APV (absolute) | 11.2 | APH-SPH (absolute) | | | 23 | |
| Free ride 171 (FIG. 15) | 11.8 | 21.3 | 51 | 82.8 | 90.2 | 6 |
| Respectively in relation to | 0.0 | 12.1 | 50.0 | 90.6 | 100 | −7.4 |
| SPV-APV (absolute) | 9.5 | APH-SPH (absolute) | | | 16.1 | |
| BX 163 (FIG. 16) | 12.5 | 25.9 | 50.9 | 76 | 89 | 7 |
| Respectively in relation to | 0.0 | 17.5 | 50.2 | 83.0 | 100 | −7.2 |
| SPV-APV (absolute) | 13.4 | APH-SPH (absolute) | | | 13 | |
| GS 185 (FIG. 17) | 10.5 | 18.2 | 53.2 | 90 | 95.2 | 4.1 |
| Respectively in relation to | 0.0 | 9.1 | 50.4 | 93.9 | 100 | −7.6 |
| SPV-APV (absolute) | 7.7 | APH-SPH (absolute) | | | 5.2 | |
| SL 162 (FIG. 18) | 10.3 | 24.1 | 49.3 | 80.5 | 94.2 | 5 |
| Respectively in relation to | 0.0 | 16.4 | 46.5 | 83.7 | 100 | −6.3 |
| SPV-APV (absolute) | 13.8 | APH-SPH (absolute) | | | 13.7 | |
| SKI 1 (FIG. 19) | 13 | 22.3 | 54.2 | 89 | 96.1 | 5 |
| Respectively in relation to | 0.0 | 11.2 | 49.6 | 91.5 | 100 | −9.6 |
| SPV-APV (absolute) | 9.3 | APH-SPH (absolute) | | | 7.1 | |
| SKI 2 (FIG. 20) | 13 | 22.4 | 54.2 | 89 | 96.1 | 5.1 |
| Respectively in relation to | 0.0 | 11.3 | 49.6 | 91.5 | 100 | −9.5 |
| SPV-APV (absolute) | 9.4 | APH-SPH (absolute) | | | 7.1 | |
| GS 193 (FIG. 21) | 9.4 | 21.5 | 56 | 86 | 94.3 | 4.5 |
| Respectively in relation to | 0.0 | 14.3 | 54.9 | 90.2 | 100 | −5.8 |
| SPV-APV (absolute) | 12.1 | APH-SPH (absolute) | | | 8.3 | |
| Extreme carving 148-2 (FIG. 22) | 11 | 43.2 | 51.3 | 65.5 | 94 | 5.5 |
| Respectively in relation to | 0.0 | 38.8 | 48.6 | 65.7 | 100 | −6.6 |
| SPV-APV (absolute) | 32.2 | APH-SPH (absolute) | | | 28.5 | |
| Maximum value (absolute) | 13 | 43.2 | 54.2 | 90 | 96.1 | 7 |
| Δ | 30.2 | | | 6.1 | | |
| Minimal value (absolute) | 10.3 | 18.2 | 49.3 | 65.5 | 89 | 4.1 |
| Δ | 7.9 | | | 23.5 | | |
| Maximum value (relative) | | 38.8 | 50.4 | 93.9 | | −9.6 |
| Minimal value (relative) | | 9.1 | 46.5 | 65.7 | | −6.3 |

| | Horizontal Projection | | | | | |
|---|---|---|---|---|---|---|
| Dimensions, % Tolerance range; | Saddle point, front (24) | Minimum width (MB) | Saddle point, rear (25) | Maximal width, rear (B2) | Drop-off, front (RV) | Drop-off rear (RH) |
| KST 153 (FIG. 12) | 6.8 | 54 | 97 | 98.1 | 35.5 | 76 |
| Respectively in relation to SPV-APV (absolute) | −5.6 | 51.7 | 104 | 105 | 29 | 78 |
| Extreme carving 148 (FIG. 13) | 7.8 | 55.9 | 96.9 | 97.9 | 39.5 | 73 |
| Respectively in relation to SPV-APV (absolute) | −3.9 | 54.1 | 103 | 105 | 34 | 75 |
| Free carving 163 (FIG. 14) | 7 | 54 | 97.2 | 98.2 | 31.5 | 78 |
| Respectively in relation to SPV-APV (absolute) | −5.1 | 51.6 | 104 | 105 | 24 | 81 |
| Free ride 171 (FIG. 15) | 7.6 | 52.8 | 94.9 | 96 | 31 | 80.5 |
| Respectively in relation to SPV-APV (absolute) | −5.4 | 52.3 | 106 | 107 | 24 | 88 |
| BX 163 (FIG. 16) | 9 | 53 | 92.9 | 93.8 | 31 | 74 |
| Respectively in relation to SPV-APV (absolute) | −4.6 | 52.9 | 105 | 106 | 24 | 80 |
| GS 185 (FIG. 17) | 5.4 | 56 | 98 | 98.2 | 31 | 80.5 |
| Respectively in relation to SPV-APV (absolute) | −6.0 | 53.7 | 103 | 104 | 24 | 83 |
| SL 162 (FIG. 18) | 6.6 | 54.5 | 97.5 | 98 | 31 | 80.5 |
| Respectively in relation to SPV-APV (absolute) | −4.4 | 52.7 | 104 | 105 | 25 | 84 |
| SKI 1 (FIG. 19) | 6.2 | 55.5 | 97.8 | 98 | 31 | 80.5 |
| Respectively in relation to SPV-APV (absolute) | −8.2 | 51.1 | 102 | 102 | 22 | 81 |
| SKI 2 (FIG. 20) | 6.7 | 54.9 | 97.4 | 97.9 | 35.5 | 72 |
| Respectively in relation to SPV-APV (absolute) | −7.6 | 50.4 | 102 | 102 | 27 | 71 |
| GS 193 (FIG. 21) | 5.5 | 56 | 97.8 | 98.2 | 32 | 79 |
| Respectively in relation to SPV-APV (absolute) | −4.6 | 54.9 | 104 | 105 | 27 | 82 |
| Extreme carving 148-2 (FIG. 22) | 7.8 | 55.8 | 96.8 | 98 | 39.5 | 73 |
| Respectively in relation to SPV-APV (absolute) | −3.9 | 54.0 | 103 | 105 | 34 | 75 |
| Maximum value (absolute) | 9 | 56 | 98 | 98.2 | 39.5 | 80.5 |
| Δ | | | | | | |
| Minimal value (absolute) | 5.4 | 53 | 92.9 | 93.8 | 31 | 72 |
| Δ | | | | | | |

-continued

| | | | | | | |
|---|---|---|---|---|---|---|
| Maximum value (relative) | −8.2 | 54.1 | 106 | 107 | 34 | 88 |
| Minimal value (relative) | −3.9 | 50.4 | 102 | 102 | 22 | 71 |

SPV-APV (absolute)
Maximum value 32.2
Minimum value 7.7
APH-SPH (absolute)
Maximum value 28.5
Minimum value 5.2

Figure 23:
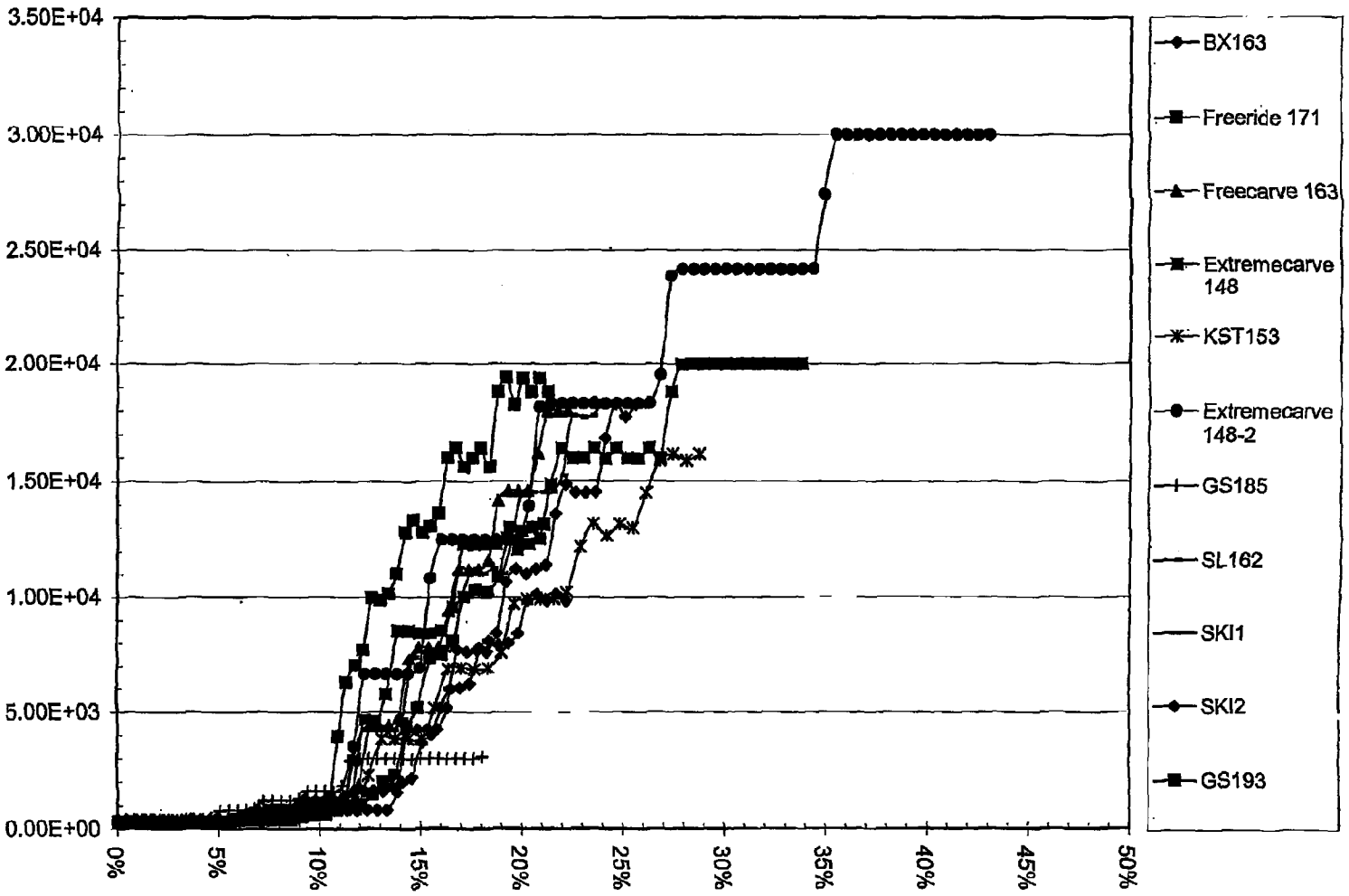
Figure 24:
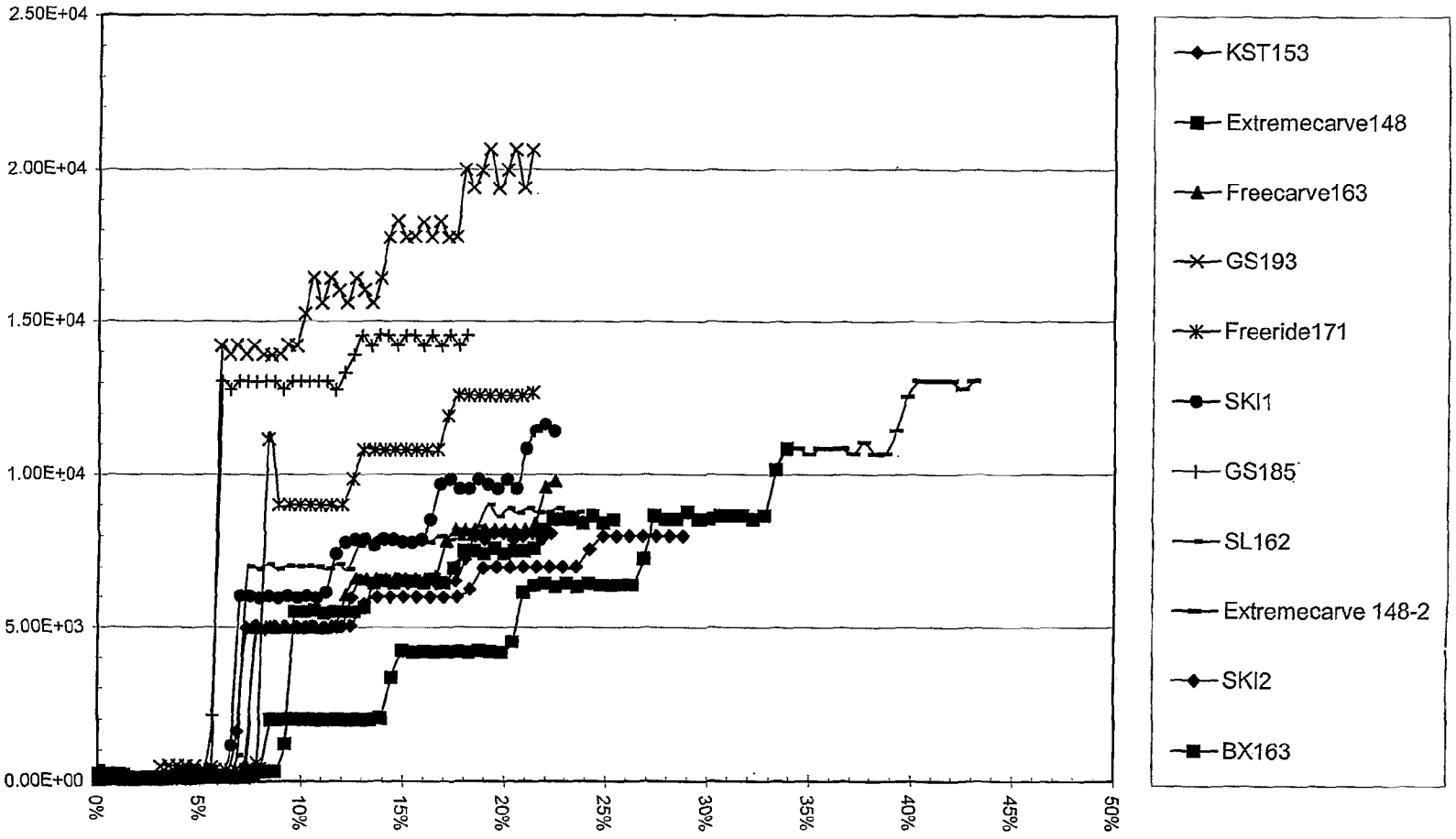

FIG. 23 schematically represents the course of the sliding surface radii RS, and FIG. 24 the course of the waist reduction radii RG in the area of the front roll-up surfaces 17 (tip to saddle point 6) of the snow sliding boards in accordance with Table 1 and FIGS. 12 to 22 (see FIG. 3). The x-axis is scaled to 100% of the length of the respective snow sliding board. The y-axis shows the radius in millimeters. It can be seen that the radii rise over certain areas. Fluctuations can be the result of measured values.

The invention claimed is:

1. A snow sliding board (1) comprising:

a tip (8), a center area (13) and a tail (9) and with a sliding surface (10) with a concave tip uptilt (21) and a concave end uptilt (23) and a convex center area (22) extending between the concave tip uptilt (21) and the concave end uptilt (23), wherein a front saddle point (6) and a rear saddle point (7) define curvature transitions between a convex radius of the center area (13) and a concave radius of the tip (8) and the tail (9) along a length of the snow sliding board (1) and saddle points (24, 25) define curvature transitions between positive and negative curvature along a width of the snow sliding board (1), wherein the concave tip uptilt (21) in an area of a front saddle point (6) terminates in the convex center area (22) in the area of the sliding surface (10), wherein the sliding surface (10) has a concave roll-up surface (17) in an area of the tip uptilt (21), which makes a load-dependent shifting of the edge pressure possible; and wherein the sliding surface radii (RS) and waisting radii (RG) decrease at least in a region bounded by respectively adjoining saddle points (6, 7) and saddle points (24, 25).

2. The snow sliding board (1) in accordance with claim 1 wherein the concave roll-up surface (17) has a constant radius (R1) of curvature.

3. The snow sliding board (1) ill accordance with claim 1 wherein a radius (R1) of curvature of the roll-up surface (17) decreases in the direction toward a front end of the snow sliding board (1).

4. The snow sliding board (1) in accordance with claim 3 wherein the radius (R1) of curvature of the roll-up surface (17) decreases in the direction toward the front end of the snow sliding board (1) continuously, at least over some areas.

5. The snow sliding board (1) in accordance with claim 3 wherein the radius (R1) of curvature of the roll-up surface (17) decreases in the direction toward the front end of the snow sliding board (1) discontinuously, at least over some areas.

6. The snow sliding board (1) in accordance with claim 1, wherein the sliding surface radii (RS) decrease on average at a greater rate than the waist restriction radii (RG).

7. The snow sliding board (1) in accordance with claim 1 wherein a curve of the waist restriction radii decreases at a greater rate towards the ends (8, 9) than a curve of the sliding surface radii.

8. The snow sliding board (1) in accordance with claim 6, wherein at least one drop-off area (RV, RH) where the curve of the waist restriction radii decreases at a greater rate towards the ends (8,9) than the curve of the sliding surface radii is located between the saddle points (6,7) of the sliding surface and, in relation to a total length L of the snow sliding board (1), is spaced apart by 0% to 20% from a closest adjoining saddle point (6, 7).

9. The snow sliding board (1) in accordance with claim 8 wherein in a no-load state the tip uptilt (21) constitutes a front contact area (2) which, in relation to the total length L of the snow sliding board (1), is arranged 5% to 35% in front of the front saddle point (6).

10. The snow sliding board (1) in accordance with claim 9, wherein in relation to the total length L of the snow sliding board (1), the front contact area (2) is arranged 8% to 20% in front of the front saddle point (6).

11. The snow sliding board (1) in accordance with claim 10, wherein in relation to the total length L of the snow sliding board (1), the front contact area (2) is arranged 9% to 14% in front of the front saddle point.

12. The snow sliding board (1) in accordance with claim 11 wherein the front contact area (2) in the undeformed state and in relation to the total length L of the snow sliding board (1) is arranged between 8% and 15% away from the front edge (L 0%) of the snow sliding board (1).

13. The snow sliding board (1) in accordance with claim 12, wherein the contact area (2) in the undeformed state and in relation to the total length L of the snow sliding board (1) is arranged between 10% and 13% away from the front edge of the snow sliding board (1).

14. The snow sliding board (1) in accordance with claim 2 wherein in relation to a total length L of the snow sliding hoard (1), a front quadrant point is arranged 3% to 10% in front of a front contact area (2).

15. The snow sliding board (1) in accordance with claim 14 wherein in relation to the total length L of the snow sliding board (1) the front quadrant point is arranged 5% to 8% in front of the front contact area.

16. The snow sliding board (1) in accordance with claim 1 wherein the sliding surface (10) has a roll-up surface (17) in the area of the end uptilt 23.

17. The snow sliding board (1) in accordance with claim 16, wherein the end uptilt (23) constitutes a contact surface (10) in the no-load state which, in relation to the total length L of the snow sliding board (1), is arranged 4% to 30% behind a rear saddle point (7).

18. The snow sliding board (1) in accordance with claim 2 wherein the radius (R1) of curvature of at least one roll-up surface (17) in the area of associated saddle points (6, 7) lies between 5000 mm and 30,000 mm.

19. The snow sliding board (1) in accordance with claim 2 wherein the radius (R1) of curvature of at least one roll-up surface (17) in the associated contact area (2, 4) is 500 mm to 2000 mm.

20. The snow sliding board (1) in accordance with claim 4 wherein the radius (R1) of curvature of the sliding surface (10) in the area of the tip uptilt (21) of the snow sliding board (1) lies at least partially between 200 mm and 500 mm.

21. The snow sliding board (1) in accordance with claim 1 wherein the tip (8) is generally blunt in the horizontal projection and includes a curvature in a center area (19) which is less than in the corner areas (18).

22. The snow sliding board (1) in accordance with claim 1 wherein the snow sliding board (1) is a snowboard.

23. The snow sliding board (1) accordance with claim 1 wherein the snow sliding board (1) is a ski.

24. The snow sliding board (1) accordance with claim 1 wherein the snow sliding board (1) is a mono-ski.

* * * * *